US005630449A

United States Patent [19]

Ammann et al.

[11] Patent Number: 5,630,449

[45] Date of Patent: May 20, 1997

[54] ENERGY STORER, FOR REDUCING DRIVE TORQUE AND IMPROVING POWER CONSUMPTION IN A WEAVING MACHINE

[75] Inventors: Stefan Ammann, Winterthur; Lorant Gacsay; Alfred Stirnemann, both of Zürich, all of Switzerland

[73] Assignee: Sulzer Rueti AG, Rueti, Switzerland

[21] Appl. No.: 511,157

[22] Filed: Aug. 4, 1995

[30] Foreign Application Priority Data

Sep. 6, 1994 [EP] European Pat. Off. ..... 94810515

[51] Int. Cl.[6] ..... D03D 49/60

[52] U.S. Cl. ..... 139/188 R; 139/145; 267/150; 267/154

[58] Field of Search ..... 267/154, 150, 267/174, 137; 139/188 R, 192, 145

[56] References Cited

U.S. PATENT DOCUMENTS 3,155,855 11/1964 Futterer ..... 267/50
5,370,325 12/1994 Borer ..... 242/43 R
5,462,093 10/1995 Froment ..... 267/150

FOREIGN PATENT DOCUMENTS 0462430 12/1991 European Pat. Off. .
73.28284 3/1974 France .
801830 1/1951 Germany .
2808202 9/1979 Germany .
50-20183 7/1995 Japan .

*Primary Examiner*—Andy Falik
*Attorney, Agent, or Firm*—Townsend and Townsend and Crew LLP

[57] ABSTRACT

In the method, a reed (3) for a weaving machine is continuously driven from a drive means (2) and the kinetic energy of the reed is stored in order to reduce the drive energy. The apparatus comprises an energy storer (1) and a drive means (2) in order to move the reed (3) back and forth. The matched oscillatable system formed by the energy storer and the reed reduces the drive torque at the uniformly rotating drive means whereby a reduction of the power consumption results.

11 Claims, 3 Drawing Sheets

ENERGY STORER, FOR REDUCING DRIVE TORQUE AND IMPROVING POWER CONSUMPTION IN A WEAVING MACHINE

BACKGROUND OF THE INVENTION

The invention relates to a method and an apparatus for the power compensation in a machine as well as to a weaving machine comprising an apparatus of this kind.

A method and an apparatus for the control of the movement of the reed of a weaving machine is described in published German patent publication DE-A-28 08 202.

It discloses that a reed is moved back and forth with a particular cycle via two energy storers independently of the weaving machine drive, the lost energy being compensated for by a supplementary energy. It proves to be disadvantageous that the sley movement produced thereby is in every case harmonic. Matching to a general form of movement is not possible.

The apparatus disclosed in the German reference comprises a doubly-acting drive device consisting of two helical springs which are arranged on opposite sides of the reed. A piston-cylinder arrangement is provided as the supplementary energy source. It has proved to be disadvantageous that the arrangement is only effective in one direction and dampens the movement in the opposite direction.

When using such an arrangement in a weaving machine, synchronization with the cycling frequency has proved to be extremely difficult if not impossible to achieve, particularly for fast-running weaving machines.

SUMMARY OF THE INVENTION

The invention aims to provide a remedy for this. The invention achieves this by providing a method and an apparatus for the optimization of the power compensation in a machine. Further, the present invention provides a weaving machine in which optimum power compensation is achieved over the entire reversible range used.

In the preferred embodiment, and contrary to the above-discussed German patent publication, the sley is positively driven by means of a form-locked drive, such as a cam drive or a crank drive, and by employing torsion rods or springs for cyclically storing and releasing energy as the sley moves through pivotal cycles defined by the sley's movements. The drive means is configured to drive or reciprocate the sley independent of the magnitude of a force exerted by the torsion rods or springs.

For example in accordance with one embodiment of the present invention, an energy conserving drive for a reed of a weaving machine is provided wherein the drive comprises a reed tube pivotally mounted on a frame on the weaving machine, means for securing the reed to the reed tube so that the reed pivotally moves with the tube, a drive shaft including means for rotating the shaft, connector means coupled with the drive shaft and the reed tube for converting rotational drive shaft motion into pivotal reed tube movements, and a torsion spring having a first portion rotationally fixed relative to the frame and a second portion rotationally fixed relative to the reed tube so that energy is stored in and released from the spring during a pivotal cycle of the reed tube caused by the rotating drive shaft.

Aside from attaining a desirable reduction of the drive energy, the present invention also reduces the mechanical loading of the drive means in an advantageous manner. A substantially play-free, form-locked connection is achieved between the reed and the drive means, the uniformity of the reed movement is improved, and the power consumption of the drive is reduced.

DETAILED DESCRIPTION OF THE PREFERRED EMBODIMENTS

An apparatus constructed in accordance with the present invention substantially comprises an energy storer or storage device 1 and a drive 2 connected to a reed 3 for moving the reed back and forth.

Figure 1:
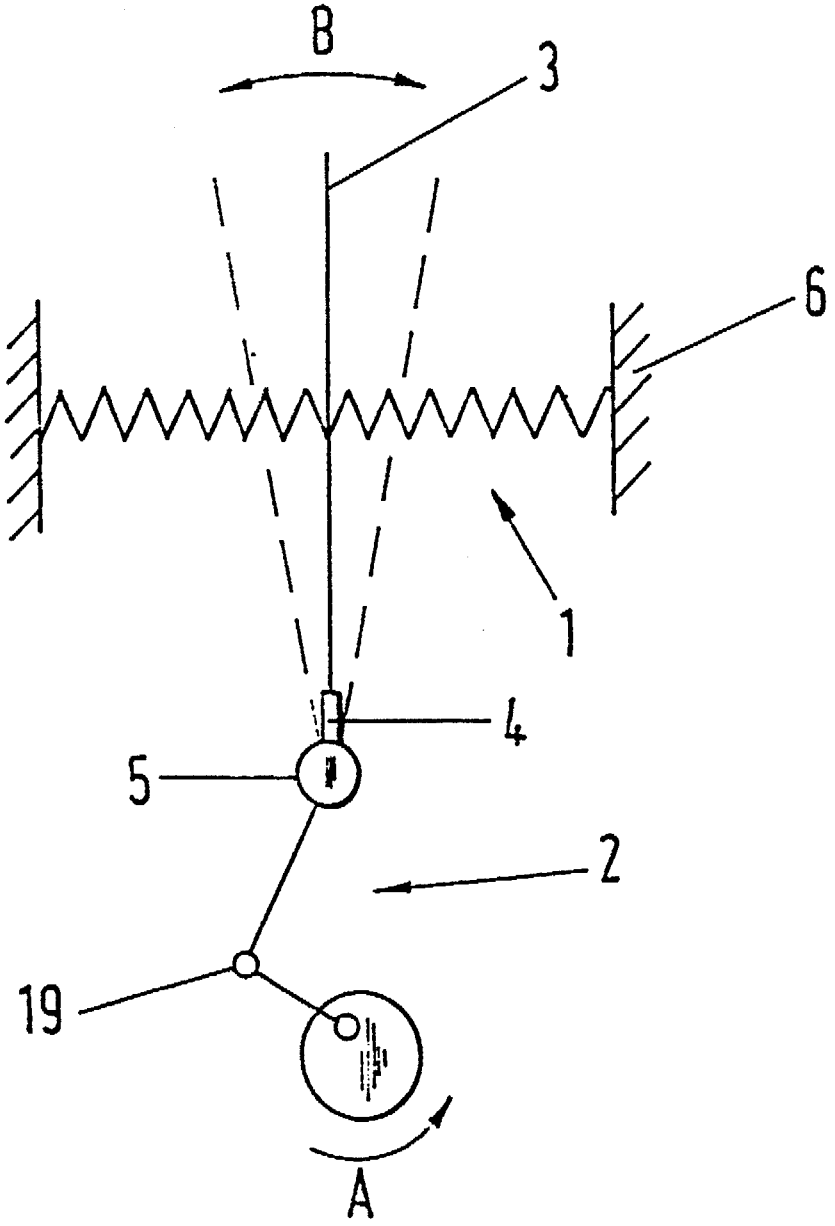
FIG. 1 is a schematic representation of an embodiment of an apparatus in accordance with the invention.

As shown in FIG. 1, the reed 3 is secured to a sley tube 5 via a reed receiver 4. Two helical springs 1 are provided as the energy storer and are arranged offset from one another on either side of the reed. The springs are connected at one end to reed 3 and at the other end to a fixed mount 6 which is part of a weaving machine frame, for example. The drive 2 is a crank drive 19 which can be connected to the main shaft of the weaving machine (not shown). When the crank drive 19 is driven at a uniform rotational speed A, its movement is converted into a pivotal movement B so that reed 3 continuously performs a to-and-fro or back-and-forth movement. As a result of the sley movement, the helical springs are tensioned, whereby the energy is consumed on the one hand in decelerating and on the other hand in reaccelerating the reed.

Figure 2:
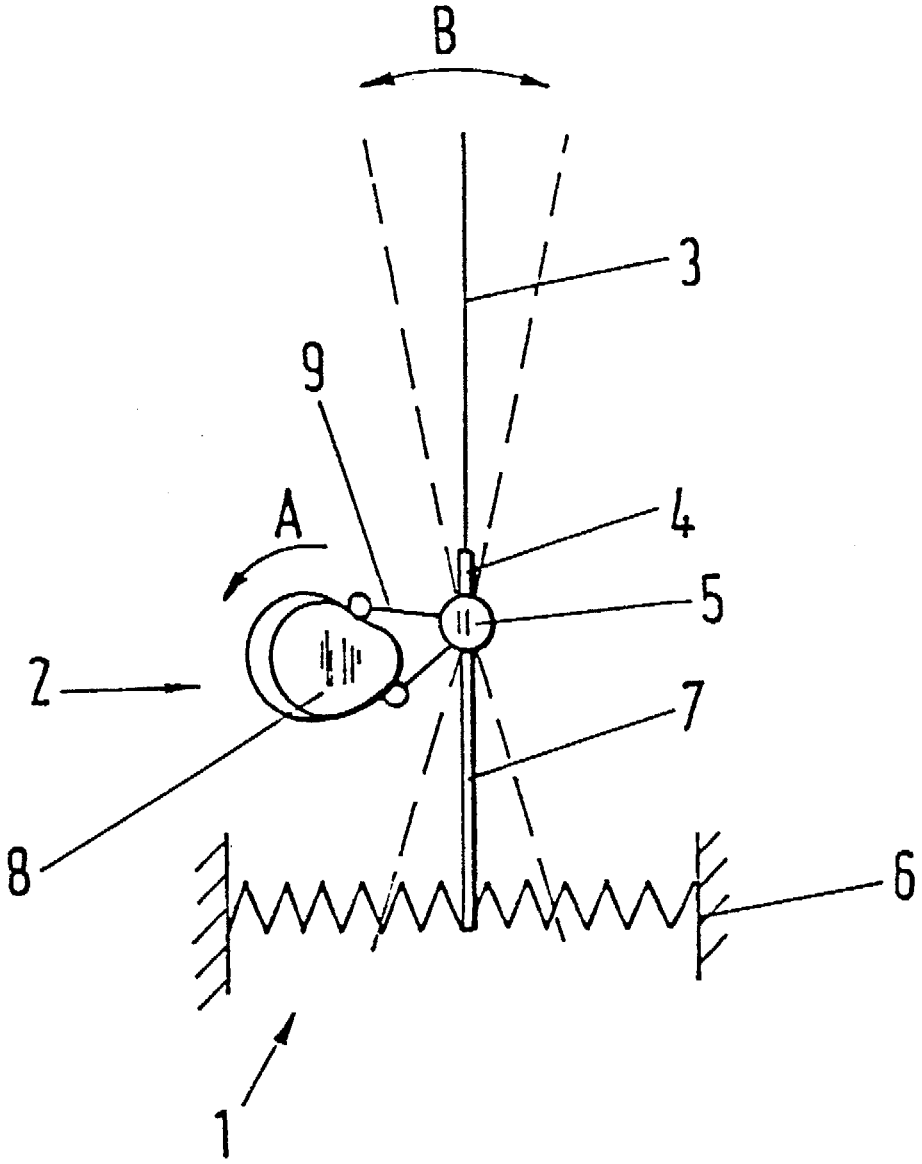
FIG. 2 shows a modified embodiment of the apparatus made in accordance with FIG. 1.

In the embodiment shown in FIG. 2, reed 3 is secured to sley tube 5 via reed receiver 4. At the sley tube, an attachment 7 is provided which is offset relative to sley tube 5. The reed 3 and reed receiver 4 as well as the attachment 7 are configured in accordance with the invention so that the masses are balanced out in relation to the rotational axis of the sley tube 5. The drive comprises a complementary cam 8 and a sley lever 9 which form a form-locked drive connection. Two helical springs 1 are provided as the energy storers and are arranged opposite to one another in relation to the attachment 7.

The function of this embodiment is substantially similar to that of the embodiment described initially and a substantially play-free, form-locked connection is achieved between the complementary cam 8 and sley lever 9.

Figure 3:
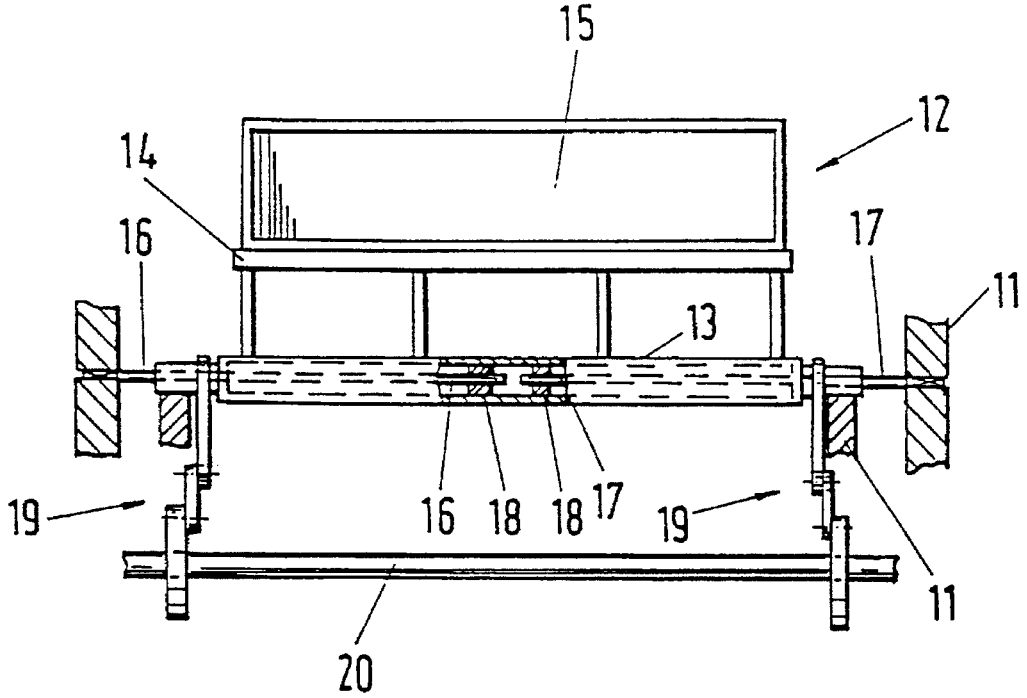
FIG. 3 is a schematic representation of a preferred embodiment of the apparatus of the invention.

FIG. 3 shows a preferred embodiment of the invention in which torsion springs are provided for storing the kinetic energy of the reed. The Figure shows sections of a weaving machine frame 11 in which sley 12 is mounted. The sley comprises a sley tube 13, a reed receiver 14 and a reed 15. Torsion spring rods 16 and 17 are provided on the weft insertion end and on the catcher end of the frame respectively. The rods 16, 17 are connected at one end to the frame 11 and at the other end to the sley tube 13 via a connector part 18. The torsion spring rods are pretensioned in mutually opposite senses. The drive is defined by two crank drives 19 arranged at the weft insertion and catcher ends of frame 11 respectively. They are driven by the main shaft or with a shaft 20 branched off therefrom.

Figure 4:
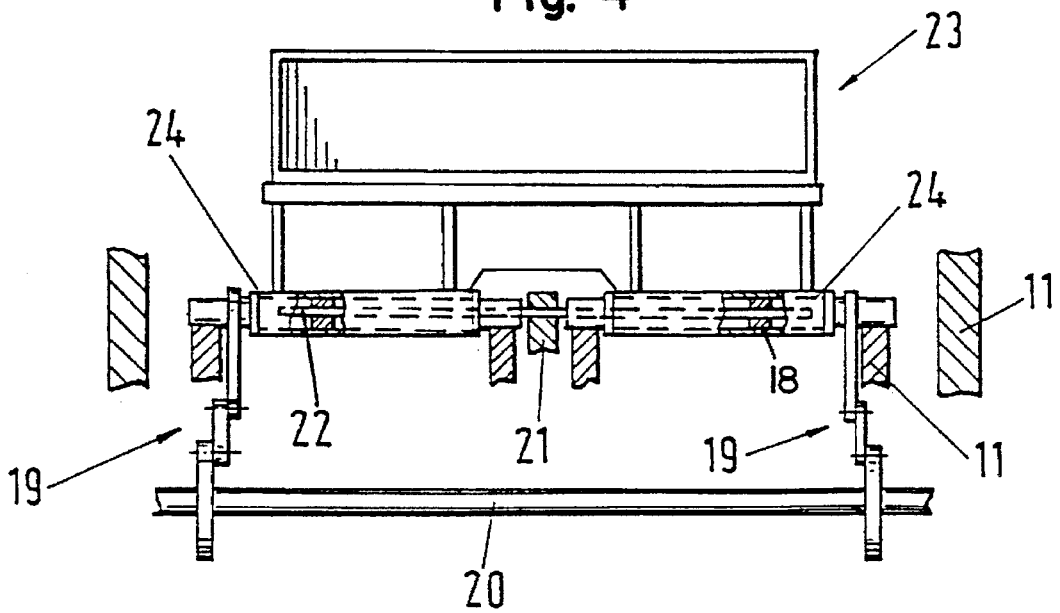
FIG. 4 shows a modified embodiment of the apparatus made in accordance with FIG. 3.

FIG. 4 shows a modified embodiment in which an individual torsion spring rod 22 is used for the energy storage.

For this, a section 21 is provided on frame 11 to which rod 22 is secured. The sley 23 has two sley tubes 24 which are mounted at either end in the frame 11 and which are each connected to a crank drive 19. The torsion rod 22 is of an elongate construction and is connected to the respective sley tube 24 in its mid region in the section 21 and at its end regions via connector pieces 18.

In place of the pretensioned torsion rods, torsion rods which are installed non-tensioned can also be used. The torsion rods are displaceable continuously or stepwise in relation to frame 11 and sley tubes 13, 24 in order to adjust the rotatable length of the torsion rod.

What is claimed is:

1. Apparatus for pivotally reciprocating a member about an axis while reducing energy requirements, the apparatus comprising the member; means pivotally mounting the member on a support; a torsion spring operatively coupled with the member and the support so that pivotal movements of the member causes the torsion spring to alternatingly store and release energy as the member pivotally reciprocates; and drive means operatively coupled with the member for pivotally reciprocating the member, said drive means being configured to reciprocate the member independent of a force exerted by the torsion spring on the member.

2. Apparatus according to claim 1 wherein the drive means comprises a rotatable drive shaft; a connector converting rotational movement of the drive shaft into a reciprocating movement; and means movably connecting the drive shaft, the connector and the member so that the rotation of the drive shaft only controls pivotal movements of the member.

3. Apparatus according to claim 2 wherein the drive shaft includes a driven cam; and wherein the connector includes means for following the cam as the drive shaft rotates to thereby cause the pivotal movements of the member as controlled by the cam.

4. Apparatus according to claim 1 wherein the means pivotally mounting the member comprises a tube; and wherein the torsion spring has a first portion rotationally fixed relative to the tube and a second portion rotationally fixed relative to the support so that pivotal movements of the tube cause torsional deflections of the torsion spring.

5. Apparatus according to claim 1 wherein the drive means comprises a driven shaft and a crank operatively coupled to the shaft and the member.

6. An energy conserving drive for a reed of a weaving machine, the drive comprising a reed tube pivotally mounted on a frame of the weaving machine; means for securing the reed to the reed tube so that the reed pivotally moves with the tube; a drive shaft including means for rotating the shaft; connector means coupled with the drive shaft and the reed tube for converting rotational drive shaft motion into pivotal reed tube movements; and a torsion spring having a first portion rotationally fixed relative to the frame and a second portion rotationally fixed relative to the reed tube so that energy is stored in and released from the spring during a pivotal cycle of the reed tube caused by the rotating drive shaft.

7. Apparatus according to claim 6 including first and second torsion springs each having a portion rotationally fixed relative to the frame and a portion rotationally fixed relative to the reed tube.

8. Apparatus according to claim 6 wherein the torsion spring is coaxial with the reed tube.

9. Apparatus according to claim 6 wherein the connector means is movably coupled to the drive shaft and the reed tube in a form-locked, substantially play-free manner.

10. A weaving machine comprising a frame; a sley including a reed mounted thereon, the sley including a sley tube pivotally mounted on the frame; a torsion spring having a first portion fixed with respect to the frame and a second portion fixed with respect to the sley tube so that reciprocating pivotal movements of the sley tube torsionally deflect the torsion spring and cause the spring to store and release energy when the sley tube pivots relative to the frame; and a drive for pivotally reciprocating the sley tube and therewith the reed during weaving, the drive forming a substantially play-free drive connection between the drive shaft and the reed tube so that an extent and a frequency of pivotal movements of the sley tube are solely determined by the rotating drive shaft; whereby, during a pivotal movement cycle of the reed tube, the torsion spring stores and releases energy to thereby reduce energy requirements of the weaving machine.

11. A weaving machine according to claim 10 wherein the torsion spring is displaceable relative to the frame and the sley tube for varying a length of the torsion spring over which it torsionally deflects during the pivotal movements of the reed tube for varying the energy stored and released by the tension spring during a pivotal movement cycle of the reed tube.

* * * * *